US005087223A

United States Patent [19]

Kaluza

[11] Patent Number: 5,087,223

[45] Date of Patent: Feb. 11, 1992

[54] MULTIPLE PLY ASSEMBLY

[75] Inventor: Rudolph T. Kaluza, Aurora, Colo.

[73] Assignee: National Graphics Company, Denver, Colo.

[21] Appl. No.: 629,382

[22] Filed: Dec. 18, 1990

Related U.S. Application Data

[63] Continuation of Ser. No. 231,776, Aug. 11, 1988, Pat. No. 4,978,142.

[51] Int. Cl.[5] ..... B41L 1/20

[52] U.S. Cl. ..... 462/2; 402/3; 229/69; 229/72; 253/79; 253/80; 253/81

[58] Field of Search ..... 229/69, 72; 282/11.5 A, 282/11.5 R, 29 B; 283/79, 80, 81; 462/2, 3

[56] References Cited

U.S. PATENT DOCUMENTS

| | | | |
|---|---|---|---|
| 713,813 | 11/1902 | Steutermann | 283/79 X |
| 2,907,585 | 10/1959 | Sornberger et al. | 282/11.5 A |
| 3,588,456 | 6/1971 | McNabb | 229/72 X |
| 3,642,195 | 2/1972 | Tulisalo | 229/72 |
| 3,791,573 | 2/1974 | Titchenal et al. | 229/69 |
| 3,947,983 | 4/1976 | Brunette | 282/11.5 A X |
| 3,987,960 | 10/1976 | Gardiner | 283/79 X |
| 4,002,356 | 1/1977 | Weidmann | 282/29 B |
| 4,051,996 | 10/1977 | Ross et al. | 229/72 |
| 4,110,502 | 8/1978 | Baer | 283/81 X |
| 4,317,538 | 3/1982 | Aiter et al. | 229/72 |
| 4,384,670 | 5/1983 | Dicker | 229/69 |
| 4,429,787 | 2/1984 | Morse | 229/72 X |
| 4,452,399 | 6/1984 | Schoenleber et al. | 229/72 |
| 4,493,496 | 1/1985 | Kaluza | 282/11.5 A |
| 4,638,940 | 1/1987 | Skokos et al. | 229/72 X |
| 4,667,984 | 5/1987 | Nitta | 283/79 X |
| 4,688,826 | 8/1987 | Hosoya | 283/79 |
| 4,733,817 | 3/1988 | Makowka | 229/72 X |

FOREIGN PATENT DOCUMENTS 2419852 11/1975 Fed. Rep. of Germany .

*Primary Examiner*—Paul A. Bell

*Attorney, Agent, or Firm*—Sheridan, Ross & McIntosh

[57] ABSTRACT

A multiple ply assembly for use as a travel ticket folder is disclosed. A first and second ply define at least two panel sections and are connected to define a sleeve within one of the panel sections to accommodate insertion of material into the sleeve. The assembly also comprises a means for restricting transverse movement of the material from the sleeve. The assembly comprises two plies of substantially the same size which are joined along one entire side and partially joined along a parallel opposing side. A non-joined portion on the opposing side forms an opening to the ticket sleeve. The assembly has two score lines defining three adjacent panels facilitating folding of the assembly into one-third portions. Itinerary information can be printed directly onto the folder. Alternatively, additional plies can be connected to the folder and itinerary information can be printed directly onto the top additional ply and reproduced onto succeeding plies. Control strips can be provided for use in advancing the assembly through a printer.

16 Claims, 6 Drawing Sheets

MULTIPLE PLY ASSEMBLY

This is a continuation of U.S. Pat. application Ser. No. 07/231,776, filed Aug. 11, 1988, now U.S. Pat. No. 4,978,142, issued Dec. 18, 1990.

FIELD OF THE INVENTION

This invention relates to travel folders for carrying, tickets, and in particular, to multiple ply assemblies for travel folders which provide an integral itinerary sheet and additional itinerary or invoice sheets.

BACKGROUND OF THE INVENTION

It is common practice when issuing tickets in the travel industry, and in particular, in the airline industry, to print itinerary sheets individually or to print several copies of itinerary sheets using carbon or other types of copy paper. When the travel ticket is issued, the ticket is enclosed in a folder, such as a three-panel folder, along with one copy of the separate itinerary sheet. This practice has several disadvantages. Travelers have to carry the separate itinerary sheet in the travel folder which can add to the bulk of the travel folder or the itinerary can be lost. Moreover, during the issuance of the travel ticket, the above-described practice requires time by the travel agent to correctly fold the separate itinerary sheet and place it in the travel folder along with the ticket.

U.S. Pat. No. 4,493,496 to Kaluza (1-15-85) describes a continuous form multiple ply assembly which addresses some of the difficulties encountered with the prior practice. The Kaluza patent describes a ticket folder which includes at least three plies. The top ply extends part way across the remaining plies. Itinerary information is printed on this top ply and copied onto the remaining plies. The second or intermediate ply defines both a ticket pocket and a second removable itinerary sheet. The intermediate ply, therefore, requires perforation to detach the second itinerary sheet from the pocket portion which remains attached to the third or back ply. The back ply also has itinerary information printed on it and can be folded along scored lines to define the three panels of the travel folder. The ticket pocket is formed by a portion of the intermediate ply which is the same size as or less than one such panel and which is attached to the back ply along two adjacent edges of the pocket.

Several disadvantages are associated with the assembly described in the Kaluza patent which are overcome by the present invention. The folder described in the Kaluza patent and its commercial embodiment are relatively complicated to manufacture because each ply is either a different size or has special scoring, die cutting or perforations. The back ply is a three-paneled sheet of paper with scores defining the three panels. The intermediate ply is substantially the same size as the back ply but the itinerary portion of the intermediate ply must be detachable from the pocket portion. The top ply is a different size from the remaining two plies. Moreover, because the folder is made of the single back ply, relatively heavy paper must be used for the back ply and the back ply therefore tends to break apart at the score lines.

Another disadvantage associated with forming the folder from a single ply is the limitation on the number of printing colors which can be used on the outside and inside folder surfaces. Web-type printers are typically limited to a given number of colors per sheet, regardless of whether the colors all appear on one side or are split between the two sides. Accordingly, for a printer with a four color capacity, a single sheet folder can only have a combined total of four colors on front and back surfaces.

In addition to manufacturing difficulties with the assembly of U.S. Pat. No. 4,493,496, as an itinerary is printed on the top ply there is a likelihood that the printer head will catch the top ply and jam because the top ply does not extend across the entire lateral width of the assembly. That is, as the printer head makes a complete lateral movement past the edge of the top ply, the printer head can catch the edge on its return path. Moreover, regarding office productivity, when the travel folder is used a travel agent must, after removing the control strips, remove the single top ply, then detach the detachable portion of the intermediate ply. Additionally, in one embodiment, a user must remove a waste portion from the remaining portion of the intermediate ply. From a time efficiency viewpoint, the several additional seconds required for the manual manipulation of such an assembly multiplied by a high volume of itineraries results in a substantial efficiency decrease. From an efficiency of materials viewpoint, the assembly requires the disposal of a substantial waste portion of paper. Also, as the folder is opened to read the itinerary on the back ply, the ticket can easily fall from the pocket.

In view of the foregoing, there is a need for a multiple ply assembly for a travel folder having simple manufacturing requirements and which is efficient in use.

SUMMARY OF THE INVENTION

In accordance with the present invention, a multiple ply assembly is provided which has a first and a second ply. The first and second plies define at least two panel sections and are connected to define a sleeve within one of the panel sections to accommodate insertion of material into the sleeve. The assembly further includes a means for restricting transverse movement of the material from the sleeve.

In one embodiment of the present invention, the two plies are at least partially joined along a first edge and partially joined along a second parallel, opposing edge. A portion of the second edge where the two plies are not joined forms an opening to the sleeve. A travel ticket, such as an airline ticket, can be inserted into the opening and received in the sleeve between the first and second plies. When inserted fully in the sleeve, the ticket may contact a joined portion of the first edge of the first and second plies. In one embodiment, the assembly can be scored along two parallel lines, which are substantially perpendicular to the first and second edges, to define three adjacent panels of approximately equal size. The opening to the sleeve along the second edge is approximately coincident with the middle panel. In this assembly, the two outer panels can be folded over the middle panel for convenient carrying of the folder. Itinerary information is printed directly onto the second ply, which is on the inside of the folder assembly to eliminate the need to carry a separate itinerary sheet in the travel folder.

In a further embodiment of the present invention, additional plies, of substantially equal size to the first and second plies, can be provided. These plies are attached to the first and second plies. On the face of the additional plies, as well as on the second ply, space is provided for printing itinerary information. The itinerary is printed on the top ply and reproduced on the remaining plies. The additional plies are then removed and used for invoice and/or record-keeping purposes and a travel ticket is inserted into the sleeve formed by the first and second plies.

In a still further embodiment, the joined first and second plies and any additional plies are connected to control strips for advancing the assembly through a printer. For example, one set of control strips can be connected to the joined first and second plies, with each additional ply having separate sets of control strips. To connect the additional plies to the joined first and second plies, the control strips of all of the plies can be connected, for example, by crimping the control strips.

DETAILED DESCRIPTION OF THE INVENTION

Figure 1:
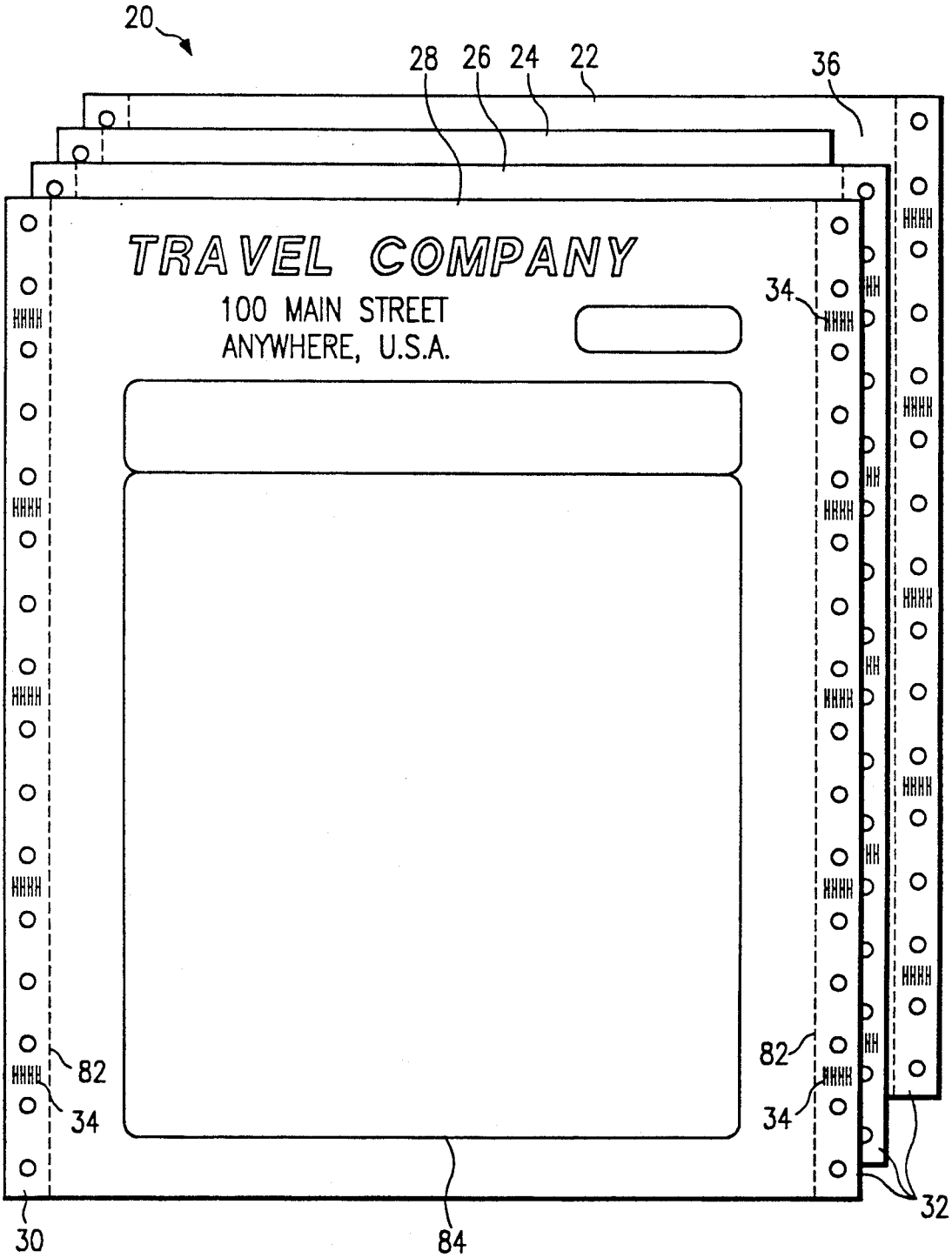
FIG. 1 is a perspective view of an embodiment of the invention having four plies and being connected with control strips.

For ease of discussion, the assemblies of the present invention will be discussed with regard to "left" and "right" edges and "top" and "bottom" edges. These terms refer to the assemblies as depicted in the drawings. It will be understood, of course, that such designations are not intended to limit the scope of the invention.

In accordance with the preferred embodiment of the present invention, FIG. 1 shows a perspective view of a four-ply assembly 20. The assembly includes a first ply 22, a second ply 24, a third ply 26, and a fourth ply 28, all of which are substantially the same size. Also shown in FIG. 1 are control strips 30, 32 for each ply 22, 24, 26, 28 and crimps 34 for connecting the plies at the control strips. It should be noted that the second ply 24, while being substantially the same size, is not exactly the same size as the other plies 22, 26, 28 and does not have a right control strip 32. As is discussed below in more detail, the first and second plies 22, 24 are joined together to form a travel folder and in one embodiment, the right side of the first ply 22 extends past the right side of the second ply 24 to form a lip 36.

Figure 2:
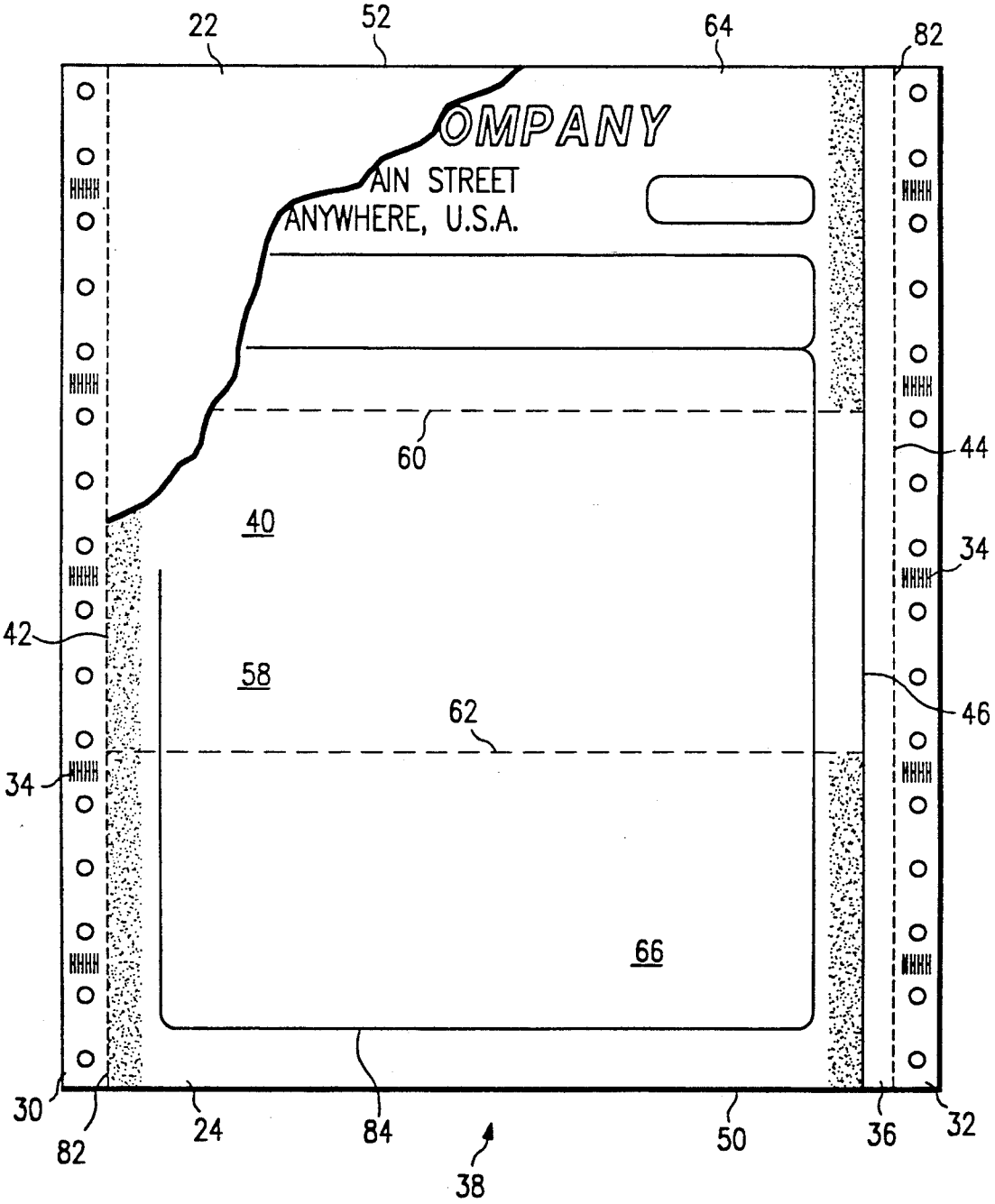
FIG. 2 is an illustration of an embodiment of the present invention having two plies showing areas of attachment between the plies in shading with a partial cut-away view of the top ply and with control strips attached to the two plies.

FIG. 2 illustrates a two-ply embodiment of the present invention, including a first ply 22 and a second ply 24 to form a two-ply assembly 38. The first and second plies 22, 24 are connected to define a sleeve 40 to accommodate insertion of material, such as a travel ticket, within the sleeve 40. As will be appreciated by those skilled in the art, the first and second plies 22, 24 can be connected in various configurations to define the sleeve 40 as long as material to be inserted into the sleeve 40 fits and is retained by the sleeve 40. Alternative configurations are described in more detail below.

Figure 3:
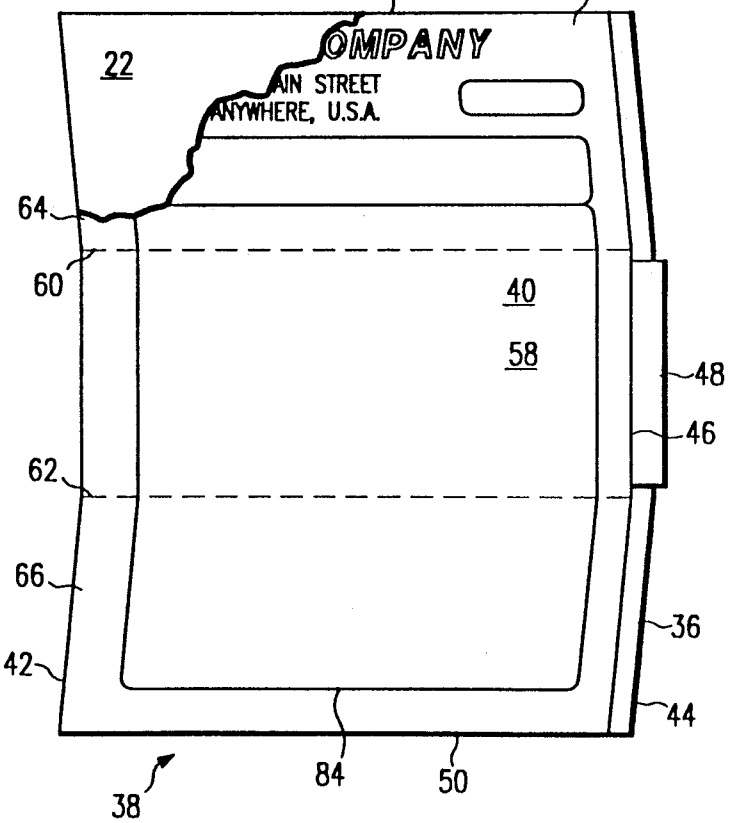
FIG. 3 is a perspective view of a two-ply embodiment of the present invention in a partially-folded configuration with an illustrative ticket placed in the pocket formed, by the two plies.

As a preferred embodiment of connecting the first and second plies 22, 24, the left sides of the first and second plies 22, 24 are joined along substantially the entire left edge 42 of the assembly 38. The right edges of the first and second plies 22, 24, i.e. the edges opposing the left edges, are partially joined along the right edge 44 of the assembly 38, to define an opening 46. The opening 46 permits insertion of a travel ticket 48 into a sleeve 40 formed by the two plies 22, 24, as depicted in FIG. 3.

In a two-ply embodiment of the present invention, as depicted in FIG. 2, travel information is printed on the second ply 24 and the first and second plies 22, 24 are folded, as described below. Several advantages are realized by use of such a two-ply folder rather than a one-ply folder as is known in the art. As discussed above, twice as many colors can be printed on a two-ply folder than on a one-ply folder for a given printing press. Moreover, a two-ply folder has a heavier, more substantial feel than a one-ply folder made of the same material. A two-ply folder, therefore, obviates the need for use of heavier, more expensive paper.

The first and second plies 22, 24 can be joined by, for example, glue or other adhesive or by other means known in the art, such as crimping. With reference to FIGS. 2 and 4–9, joined portions are shown by shading. In this regard, it should be noted that the plies 22, 24 can be joined by continuous placement of adhesive along the joined edges, as shown, for example, on the left edge 42 of the assembly 38 in FIG. 4. Alternatively, the plies 22, 24, can be joined by placing adhesive at spot intervals along the joined edges, as shown, for example, on the bottom edge 50 of the assembly 38 shown in FIG. 4.

With reference to FIG. 2, the joined portion of the left edge 42 of the first and second plies 22, 24 is joined along the entire length of the left edge 42 of the plies 22, 24. However, it should be noted that the first and second plies 22, 24 need only be joined along the portion of the left edge 42 of the plies 22, 24 that is directly opposite from the opening 46 formed on the right edge 44 of the plies 22, 24. In this manner, as a ticket 48 is inserted through the opening 46 on the right edge 44 of the plies 22, 24, the ticket 48 is prevented from passing through the left edge 42 of the plies 22, 24.

The right edge 44 of the joined first and second plies 22, 24 defines an opening 46 for insertion of a ticket 48. The opening 46 is defined by a portion of the right edge 44 of the first and second plies 22, 24 which is not joined and which is bounded on both sides by portions of the right edge 44 of the first and second plies 22, 24 which are joined. The opening 46 is of sufficient size that the ticket 48 for which the assembly 38 is designed can easily be inserted through the opening 46 into the sleeve 40. In this manner, a ticket 48 is securely held in the sleeve 40 and cannot fall out of the sleeve 40 through the side.

In FIG. 2, the length of the opening 46 is approximately one-third of the length of the right edge 44 of the first and second plies 22, 24. The opening 46 of the right edge 44 of the first and second plies 22, 24 in FIG. 2 is centered along the right edge 44 of the first and second plies 22, 24. The remaining portions of the right edge 44 of the first and second plies 22, 24 on either side of the opening 46 are continuously joined, as shown by the shading. Alternatively, the opening 46 can be bounded by only spot joined portions. In this manner, the right edge 44 of the first and second plies 22, 24 would still define an opening 46 for insertion of a ticket 48.

Figure 6:
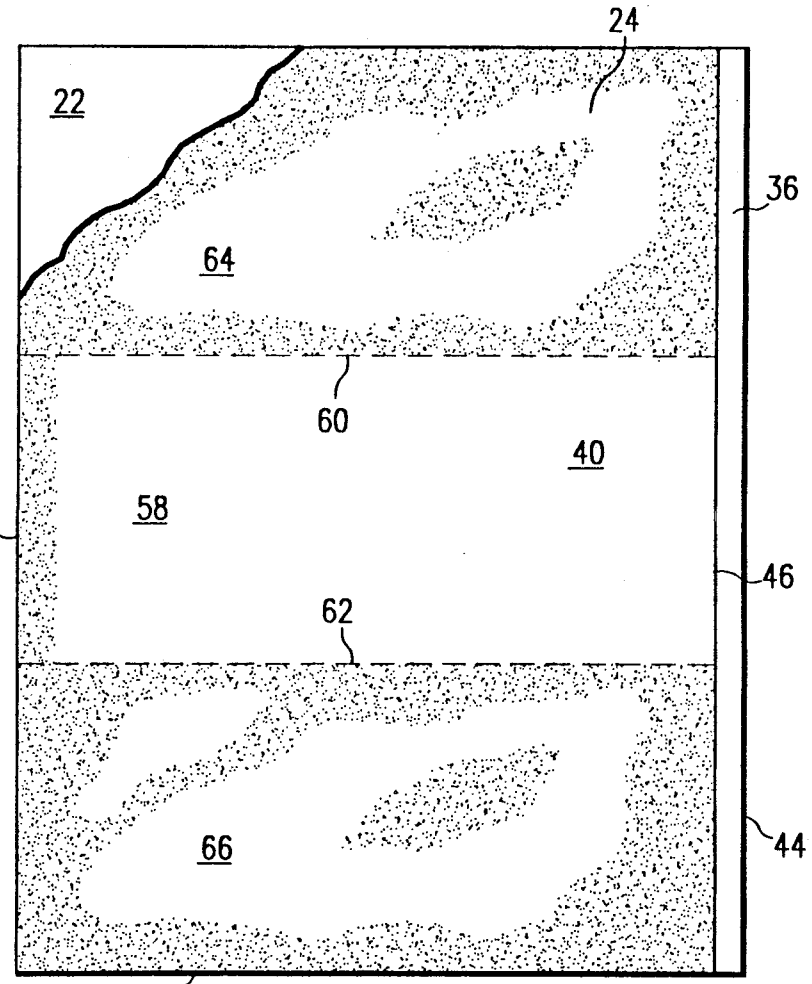
FIG. 6 is an illustration of a two-ply embodiment of the present invention in which the plies are entirely joined except for the ticket sleeve.
Figure 5:
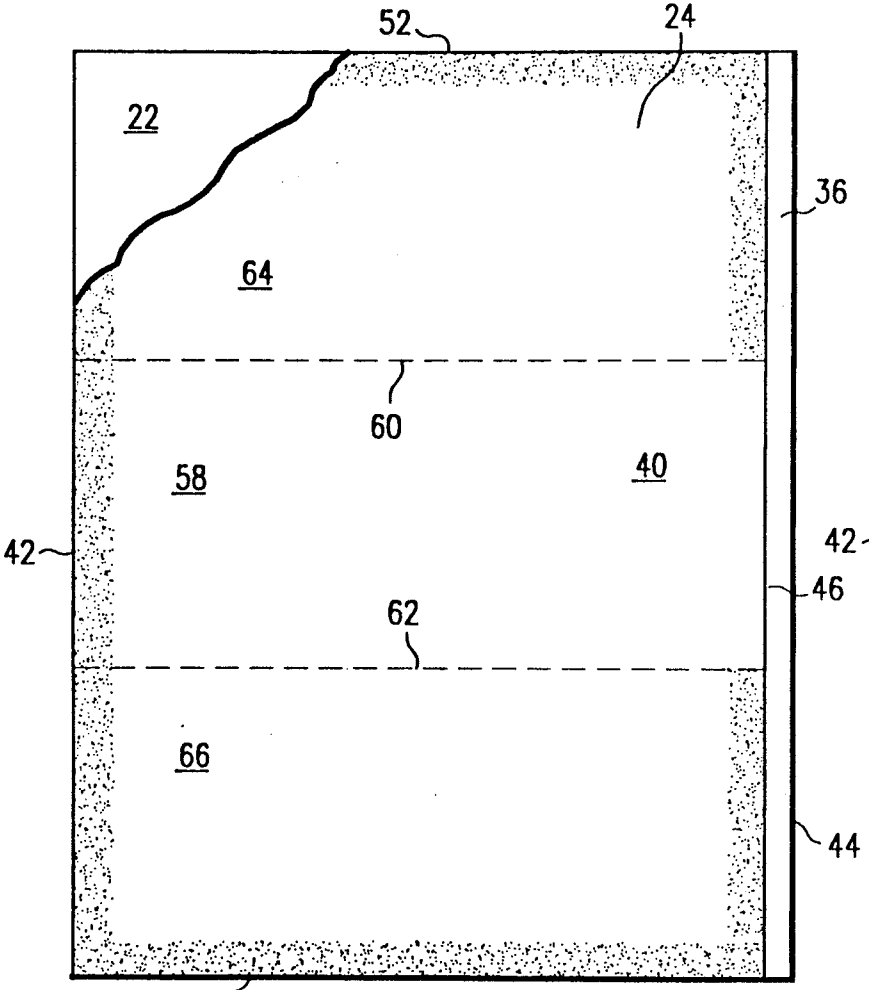
FIG. 5 is an illustration of a two-ply embodiment of the present invention in which the plies are joined around the entire periphery of the assembly, except for the opening to the ticket sleeve.

FIG. 2 also depicts the first and second plies 22, 24 as not being joined along the top edge 52 and bottom edge 50, except where the joined portions of the left and right edges extend to the top and bottom edges 52, 50. The assembly 38 depicted in FIG. 2 can be joined, in alternative fashions. For example, the first and second plies 22, 24 can be joined along the entire periphery of the plies, except for the opening 46, as shown in FIG. 5. As another alternative, the first and second plies 22, 24 can be completely joined, except for the opening 46 and sleeve 40, as shown in FIG. 6.

Figures 7, 8, 9:
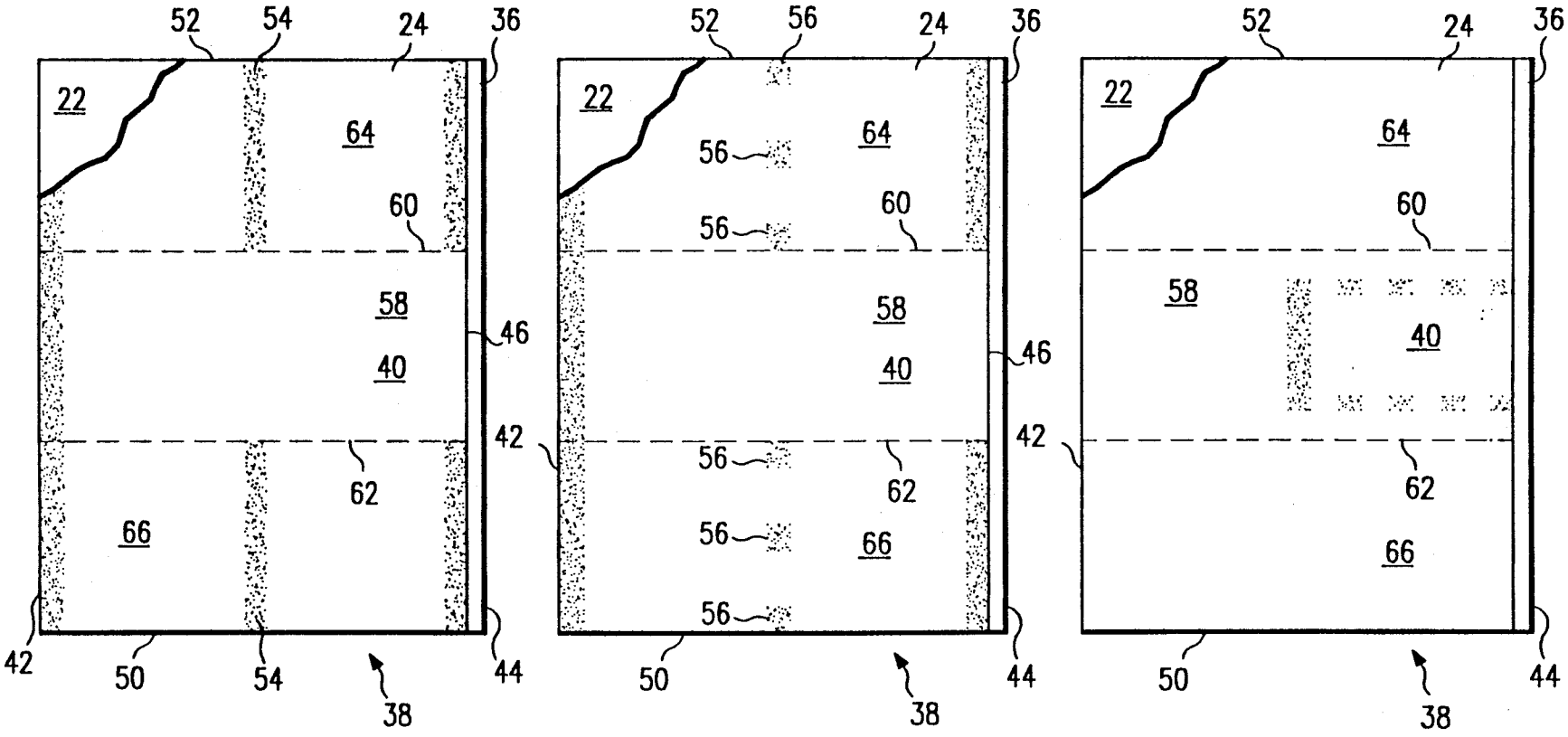
FIG. 7 is an illustration of a two-ply embodiment of the present invention showing an alternative configuration for joining the two plies.
FIG. 8 is an illustration of a two-ply embodiment of the present invention showing an alternative configuration for joining the two plies.
FIG. 9 is an illustration of a two-ply embodiment of the present invention showing an alternative configuration for joining the two plies.

FIGS. 7 and 8 show assemblies having the first and second plies 22, 24 joined by lateral glue strips 54 and lateral rows of glue spots 56, respectively, on the top and bottom panels. In this manner, a ticket 48 is prevented from moving laterally in the sleeve 40. Such restriction of transverse movement of a ticket 48 from the sleeve 40 ensures that a ticket 48 will not be accidentally lost. The assemblies depicted in FIGS. 7 and 8 are simple to manufacture because application of glue can be accomplished by a machine only having one-dimensional, i.e. lateral, capability of glue application. More complicated gluing patterns require more sophisticated gluing machines and possibly application of glue by a plating process.

It should be noted that the sleeve 40 can be defined by connecting portions of the first and second plies 22, 24 as being smaller than a panel 58 of the folder. For example, the sleeve 40 can be configured as shown in FIG. 9.

Figure 10:
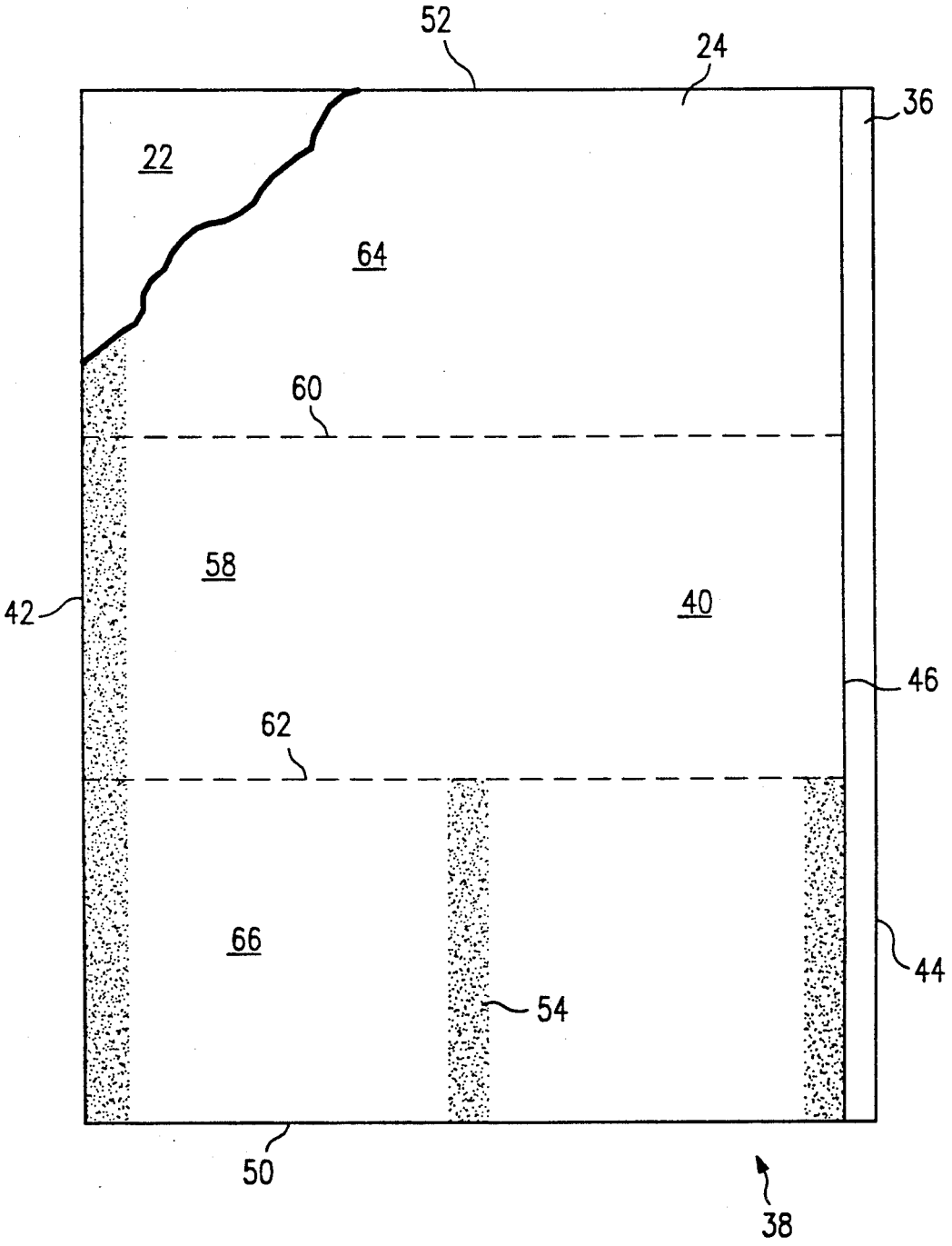
FIG. 10 is an illustration of a two-ply embodiment of the present invention showing an alternative configuration for joining the two plies.

Another alternative embodiment for joining the first and second plies 22, 24 is shown in FIG. 10. The plies 22, 24 are joined along the entire left edge 42 of the assembly 38. The bottom panel is also joined by a lateral glue strip 54 and along the right edge 44. The top and center panels, however, are only joined along the left edge 42. This configuration allows for insertion of a ticket 48 into the sleeve 40 through the top edge 52 of the assembly 38, rather than being limited to insertion of a ticket 48 only through the right edge 44 of the sleeve 40. Such a configuration is particularly useful for tickets 48 which are soft or non-rigid and which may be difficult to insert through a sleeve opening 46 which is only slightly wider than the ticket 48.

FIG. 2 also depicts the first ply 22 as being wider than the second ply 24 to form a lip 36 along the entire length of the right edge 44 of the assembly 38. This design facilitates the insertion of a ticket 48 into the opening 46 between the two plies 22, 24 because the first and second plies 22, 24 can be more easily separated at the opening 46. It has been found that a lip 36 of about $\frac{3}{8}$ of an inch is convenient for separating the first and second plies 22, 24 at the opening. However, larger or smaller lips 36 are also effective.

With further regard to the embodiment of the present invention depicted in FIGS. 2 and 3, score lines 60, 62 are shown. As depicted in FIG. 3, score lines 60, 62 are shown going through both plies 22, 24. In an alternative embodiment, only the first or outside ply 22 is scored. The score lines 60, 62 define three adjacent panel sections 64, 58, 66 with the sleeve 40 within the center panel 58. The score lines 60, 62 facilitate folding of the assembly 38 into one-third portions. The assembly 38 shown in FIG. 3 has the opening 46 on the center panel 58 with a travel ticket 48 inserted in the sleeve 40. When folded, the top panel 64 is folded onto the center panel 58 and the bottom panel 66 is folded onto the top panel 64. In this manner, the assembly 38 is folded into a convenient size for placing in a pocket or other location while traveling.

Figure 4:
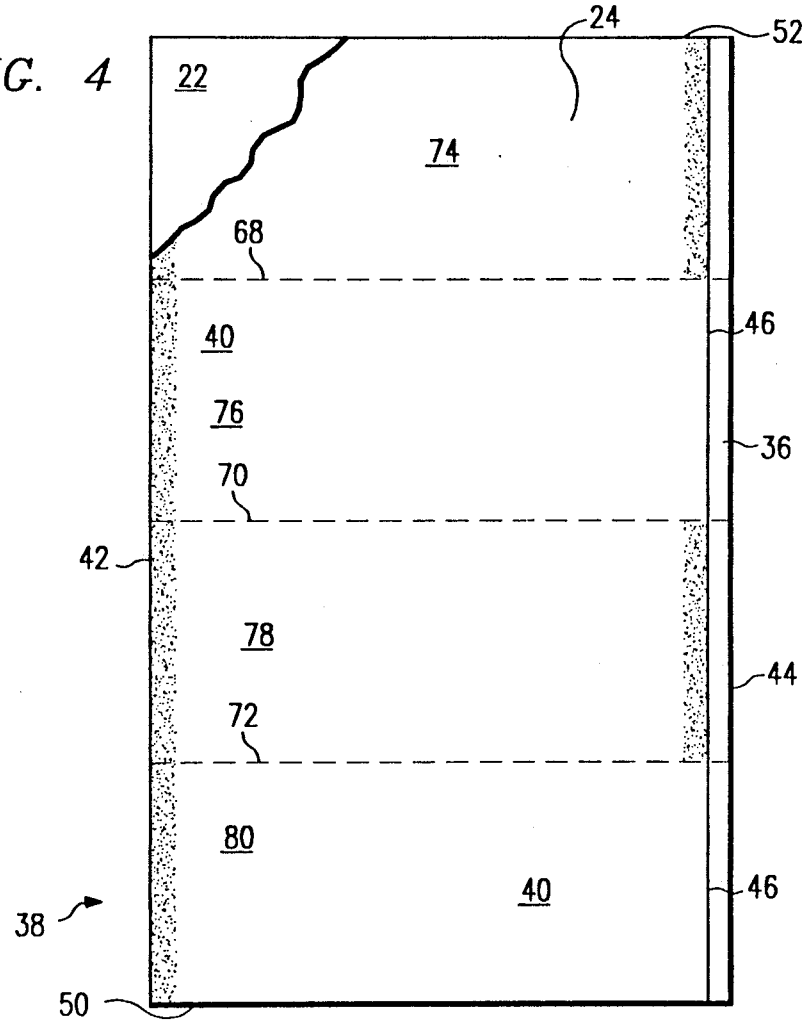
FIG. 4 is an illustration of a two-ply embodiment of the present invention having four panels and two pockets formed by the two plies showing areas of attachment between the plies in shading.

As shown in FIG. 4, the assembly 38 of the present invention can also include three score lines 68, 70, 72 to define four adjacent panels 74, 76, 78, 80. Further, the assembly 38 can include additional panels, if desired. By having four or more panels, one, two or more sleeves 40 can be formed in the assembly 38. For example, in FIG. 4, the assembly 38 has four panels 74, 76, 78, 80, two of which are sleeves 40. This embodiment could be used, for example, when a travel agency issues tickets for two people traveling together or, for example, to provide room for holding other documents, such as discount coupons, car rental receipts or the like. In such an embodiment which includes two or more openings 46 defining two or more sleeves 40, the left edge 42 of the first and second plies 22, 24 is joined along the entire left edge 42. The openings 46 on the right edge 44 of the joined first and second plies 22, 24 are defined by joined portions along the right edge 44, as shown by shading in FIG. 4.

An assembly 38, as illustrated in FIG. 4, can be folded in various ways. For example, the assembly 38 can be folded first along score line 70 and then second along score lines 68 and 72 to produce a folded assembly 38 having the dimensions of one panel. Alternatively, panel 74 can be folded along score line 68 onto panel 76 with panel 80 being folded along score line 72 with the entire assembly 38 then being folded along score line 70 to produce a folded assembly having the dimensions of one panel size.

With reference to FIG. 2, a two-ply assembly 38 is depicted with control strips 30, 32. Control strips 30, 32 are useful for advancing an assembly through a printer (not shown). Typically, after information is printed on an assembly 38 and it is removed from the printer, the control strips 30, 32 are removed from the assembly at perforations 82.

The right control strip 32, depicted in FIG. 2, is attached only to the first ply 22. The right edge of the second ply 24, as depicted in FIG. 2, does not extend out to the right edge of the first ply 22 so that a lip 36 is formed. The control strip 30, depicted in FIG. 2, on the left edge of the assembly 38 is either a single control strip 30 attached to the left edge of the first ply 22 or two control strips 30, with one attached to the left edge of the first ply 22 and one attached to the left edge of the second ply 24.

With reference to FIG. 1, additional plies 26, 28 are illustrated. Each of the additional plies 26, 28 has control strips 30, 32 which are connected to the left and right edges of each ply 26, 28. Each of the additional plies 26, 28 is attached to the other additional ply and to the first and second plies 22, 24 by crimping together the control strips 30, 32 to form crimps 34. It should be noted that, while two additional plies 26, 28 are illustrated, further additional plies could be provided as desired.

The additional plies 26, 28 are substantially the same size as the first and second plies 22, 24 and extend to the left and right edges of the first ply 22. One aspect of the present invention is that the additional ply 28 on which information is printed extends across the entire lateral width of the assembly 20 and preferably, that such an additional ply 28 have both the left and right edges of the ply 28 connected to the remainder of the assembly 20. In this manner, as a printer head (not shown) makes lateral movements across an assembly 20 it will not catch on an edge of the outer ply 28. Also, even if a printer head were to create a lateral pulling on the additional ply 28 by not coming completely out of contact with the additional ply 28 prior to lateral movement, the additional ply 28 is not lifted from the remainder of the assembly 20 by virtue of being connected to the assembly 20 at both the left and right edges.

The additional plies 26, 28 can be made of carbonless copy paper so that as information is printed on the top ply 28 within the information border 84, the information is reproduced on the succeeding plies 26, 24. Alternatively, carbon paper (not shown) can be assembled between the plies 24, 26, 28 for reproducing information to succeeding plies.

Typically, the first and second plies 22, 24 will be made of heavier paper than the additional plies 26, 28 to form a stiffer travel folder than would be obtained with a lighter weight paper. The additional plies 26, 28, which can be used as invoice copies or record itinerary copies, are most typically made of lighter weight paper.

In use of the present invention, an assembly 20, as depicted in FIG. 1, is inserted in a printer (not shown) and advanced by way of the control strips 30, 32 being advanced. As travel itinerary information is printed on the top additional ply 28 in the information border 84 the information is reproduced onto the other additional ply 26 and onto the second ply 24 in information borders 84 on the other plies 24, 26. After the information is completely printed, the assembly 20 is removed from the printer. Control strips 30, 32 of each ply 22, 24, 26, 28 are removed by the travel agent. The additional plies 26, 28 are then no longer attached to the first and second plies 22, 24. The additional plies 26, 28 can then be used for their designated purpose, for example, as record copies or as an invoice. The remaining joined first and second plies 22, 24 have the travel information printed on the face of the second ply 24 for easy reference by the traveler. The travel ticket 48 can then be inserted in the opening 46 and the panels 64, 58, 66 can be folded together along the score lines 60, 62.

It should be noted that while the control strips 30, 32 are depicted in the Figures as being attached to the left edge 42 and right edge 44 of the plies 22, 24, 26, 28, the control strips 30, 32 could alternatively be attached along the top edge 52 and bottom edge 50 of the plies 22, 24, 26, 28. In this embodiment, as the assembly 20 is advanced through a printer, the assembly 20 will be oriented such that the sleeve 40 formed by the first and second plies 22, 24 is rotated 90° from the orientation depicted in FIG. 2.

Based on the above detailed description, several important features of the present invention are readily apparent. The assembly is relatively simple to manufacture because each ply is of substantially the same size and no perforations are required in any of the plies to detach portions thereof. The assembly is simple in use because once the control strips are removed, no further tearing or disassembly of any plies is required. The loose additional plies can be used for their designated purpose and the travel folder for holding the ticket is complete. The present invention also reduces the number of articles to be carried by a traveler since the itinerary is printed directly onto the travel folder, rather than onto a separate itinerary sheet which must be carried in a folder pocket along with the travel ticket.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. A multiple ply assembly, comprising:

first and second plies, wherein said first and second plies are correspondingly scored along at least one score line to define at least two assembly panels;

connecting means for joining said first and second plies, wherein said connecting means are positioned only along at least portions of a plurality of displaced and substantially parallel lines; and a sleeve defined by corresponding portions of said first and second plies and positioned in at least one of said assembly panels, said sleeve being open at one end and at least partially closed on the other end by at least portion of said connecting means.

2. A multiply ply assembly, as claimed in claim 1, wherein said first and second plies have substantially equal dimensions.

3. A multiply ply assembly, as claimed in claim 1, wherein said first and second plies each have a first and second dimension, said first dimension of each of said first and second plies being substantially equal, said second dimension of each of said first and second plies being unequal.

4. A multiple ply assembly, as claimed in claim 1, further including closure means formed along said at least one score line for closing a side of said sleeve by folding said multiple ply assembly along said score line.

5. A multiple ply assembly, as claimed in claim 1, wherein said first and second plies are scored along at least two substantially parallel score lines to define three assembly panels.

6. A multiple ply assembly, as claimed in claim 5, wherein said sleeve is positioned in said middle panel assembly.

7. A multiple ply assembly, as claimed in claim 6, further including closure means formed along said score lines for closing two sides of said sleeve by folding said multiple ply assembly along said score lines.

8. A multi-ply assembly, as claimed in claim 1, wherein said connecting means is an adhesive positioned between said first and second plies.

9. A multiple ply assembly, as claimed in claim 1, wherein said connecting means is continuously positioned along at least one of said connecting lines.

10. A multiple ply assembly, as claimed in claim 28, wherein said connecting means is intermittently positioned along at least one of said connecting lines.

11. A multiple ply assembly, as claimed in claim 1, further including restricting means positioned between said ends of said sleeve, said restricting means being positioned along at least portions of at least one line which is substantially parallel to said connecting means to define at least a portion of at least one side of said sleeve.

12. A multiple ply assembly, as claimed in claim 11, wherein said restricting means is adhesive positioned between said first and second plies.

13. A multiple play assembly, as claimed in claim 1, further including additional plies detachably connected to and positioned on top of said first and second plies.

14. A multiple ply assembly, as claimed in claim 13, further including means for reproducing information printed on the top said ply and transferring said information to said plies positioned under said top ply.

15. A multiple ply assembly, as claimed in claim 2, further including parallel control strips connected to two opposite edges of said first and second plies.

16. A multiple ply assembly, as claimed in claim 3, further including parallel control strips connected to opposite edges of said first ply and to one edge of said second ply.

* * * * *